US005738618A

United States Patent [19]

Lemerand et al.

[11] Patent Number: 5,738,618

[45] Date of Patent: Apr. 14, 1998

[54] BLANKET SEALING BAG MACHINE

[75] Inventors: Sean K. Lemerand, Seymour, Wis.; Wim Verbeiren, Lede, Belgium; Paul W. Staab, Manlius, N.Y.; Ronald L. Lotto, Bonduel; Danford C. Anderson, Green Bay, both of Wis.

[73] Assignee: FMC Corporation, Chicago, Ill.

[21] Appl. No.: 880,876

[22] Filed: Jun. 23, 1997

Related U.S. Application Data

[63] Continuation of Ser. No. 595,720, Feb. 2, 1996, abandoned.

[51] Int. Cl.[6] ..... B31B 1/64

[52] U.S. Cl. ..... 493/208; 493/193; 493/201; 493/202

[58] Field of Search ..... 493/186, 189, 493/190, 193, 195–202, 205, 208, 230, 233, 238, 471, 3, 171, 11; 226/170, 171, 175, 191

[56] References Cited

U.S. PATENT DOCUMENTS

| | | | |
|---|---|---|---|
| Re. 29,644 | 5/1978 | Simpson et al. | 493/208 |
| 1,931,860 | 10/1933 | Cherry | 226/171 |
| 1,956,545 | 4/1934 | Schrader et al. | 226/171 |
| 2,815,063 | 12/1957 | La Fleur | 493/193 |
| 2,999,533 | 9/1961 | Slagel et al. | 493/201 |
| 3,004,881 | 10/1961 | Van Der Meulen | 493/197 |
| 3,107,585 | 10/1963 | Nystrand | 493/198 |
| 3,114,512 | 12/1963 | Peshel et al. | 226/171 |
| 3,221,613 | 12/1965 | Sanders | 493/198 |
| 3,893,884 | 7/1975 | Class | 493/197 |
| 3,955,604 | 5/1976 | Braun | 226/171 |
| 4,003,298 | 1/1977 | Schott, Jr. | 493/189 |
| 4,023,470 | 5/1977 | Van Der Meulen | 493/208 |
| 4,114,520 | 9/1978 | Achelpohl et al. | 493/199 |
| 4,332,578 | 6/1982 | Van Der Meulen | 493/208 |
| 4,642,084 | 2/1987 | Gietman, Jr. | 493/197 |
| 4,758,293 | 7/1988 | Samida | 493/193 |
| 4,854,983 | 8/1989 | Bryniarski et al. | 493/193 |
| 4,867,735 | 9/1989 | Wogelius | 493/197 |
| 4,902,374 | 2/1990 | Smith et al. | 493/208 |
| 4,934,993 | 6/1990 | Gietman, Jr. | 493/202 |
| 4,976,673 | 12/1990 | Smith et al. | 493/208 |
| 5,215,514 | 6/1993 | Flyghagen et al. | 493/205 |
| 5,292,299 | 3/1994 | Anderson et al. | 493/197 |
| 5,417,638 | 5/1995 | Anderson et al. | 493/197 |
| 5,447,486 | 9/1995 | Anderson et al. | 493/197 |
| 5,518,559 | 5/1996 | Saindon et al. | 493/202 |
| 5,587,032 | 12/1996 | Saindon et al. | 493/208 |

OTHER PUBLICATIONS

RB–840 Rotary Bag Machine Brochure, FMC Corp.,1991, Green Bay, WI.

RB–1300 Draw Tape Brochure, FMC Corp.,Green Bay, No Date.

RB–840LD Rotary Bag Machine,FMC Corp.,Green Bay, WI,Mar. 1996 Continuous Motion Rotary Bottom Weld Bag Machine, FMC Corp. Green Bay, WI, 1993.

Model 1552–ED Rotary Bag Machine, FMC Corp.,Green Bay, WI, Oct. 1993.

Model 5013–ED Rotary Poly Bag Machine, FMC Corp., Green Bay, WI Oct. 1994.

*Primary Examiner*—Joseph J. Hail, III
*Assistant Examiner*—Christopher W. Day
*Attorney, Agent, or Firm*—Michael C. Penn

[57] ABSTRACT

There is provided a blanket sealing bag machine having a variable diameter sealing drum comprising a plurality of spindles disposed at a first end of an axle and a like plurality of spindles disposed at an opposing end of the axle, the plurality of spindles being greater than sixteen spindles, the spindles extending radially from the axle. There is further provided a blanket sealing bag machine that maximizes the angle of blanket wrap.

20 Claims, 7 Drawing Sheets

BLANKET SEALING BAG MACHINE

This application is a continuation of application Ser. No. 08/595,720, filed Feb. 2, 1996 now abandoned.

BACKGROUND OF THE INVENTION

1. Field of the Invention

This invention relates to bag fabricating machines and more particularly to blanket sealing bag machines for the production of sealed polyethylene products.

2. Description of Related Art

Prior art blanket sealing bag machines typically utilize a variable diameter drum consisting of two disks of an appropriate distance apart mounted upon a common axle. The common axle is driven by conventional means inducing rotating motion to the axle and the two disks. Fastened to each of the disks are equally spaced spindles, such as twelve or sixteen spindles, which extend radially from the axle and extend to the outer diameter of the disks.

The spindles in each disk are connected to the opposing spindle on the other disk with either a slat or a seal bar assembly. Slats, which are mechanically joined to each of the two opposing spindles, are structural members which define the cylindrical geometry of the sealing drum. The seal bar assemblies, fastened in a manner similar to the slats, also form the drum geometry as well as provide sealing means for placing transverse thermal seals on the polyethylene web provided to the drum.

The drum diameter is adjustable through a motor driven means which rotates all of the threaded spindles in the desired direction, thus lowering or raising the slats and seal bar assemblies relative to the drum axle. This increases or decreases the diameter of the sealing drum. An example of a prior art blanket sealing bag machine is disclosed in U.S. Pat. No. 5,447,486 owned by Applicants' assignee and is incorporated herein by reference.

The sealing process produced by the drum sealing machine may, for example, be accomplished by placing a tube of polyethylene web between the drum geometry and a sealing blanket conforming to the external geometry of the drum. Heat necessary for creating seals is applied through the polyethylene web via one or more seal bar assemblies and pressure necessary for creating seals is produced via sealing blanket tension against the drum. Duration of seal dwell is determined by the linear speed of the rotating drum, the diameter of the drum, and the amount of blanket wrap around the drum.

The linear speed at which thermal webs may be sealed is dependent upon the duration of time heat is applied to the thermal web, the amount of pressure that the sealing assembly is in contact with the thermal web, and the temperature of the sealing assembly. Temperature and pressure are independent of the number of seal bar assemblies mounted onto the drum and as a consequence, these values may be optimized irrespective of the number of seal bar assemblies or the diameter of the drum. For example, the temperature of the seal bar may range from three hundred fifty to five hundred degrees Fahrenheit and the blanket sealing pressures may range from four to five pounds per linear inch of the blanket.

Where the sealing drum comprises a given number of spindles, the number of seal bar assemblies used is generally an integral multiplicand of the given number of spindles. However, because prior art blanket sealing bag machines have only at most twelve or sixteen spindles, seal dwell time may often not be optimized for a variety of desired bag lengths produced by the machines. Specifically, a blanket sealing machine having only twelve spindles may only have seal bar assemblies placed on one, two, three, four ,six, or all of the spindles (i.e., integral multiplicands of twelve) during a given production run. Similarly, a blanket sealing machine having only sixteen spindles may only have seal bar assemblies placed on one, two, four, eight, or all of the spindles (i.e., integral multiplicands of sixteen) during a given production run. Where seal time is not optimized, an undesirable reduction in production rates may result.

To help achieve maximum production speeds, it is desirable to increase the multiples of seal bar assemblies by providing a seal drum having more than sixteen spindles at each end. Where more spindles are used, the seal drum may be larger and may also allow for more seal bar combinations. This may allow the running of standard bag lengths on the blanket sealing bag machine with the drum being as large as possible in comparison to conventional designs. Further, because the amount of blanket wrap around the drum affects duration of seal dwell time, it is also desirable to provide a blanket sealing bag machine having a larger angle of blanket wrap.

SUMMARY OF THE INVENTION

There is provided a blanket sealing bag machine comprising an axle, a first plurality of spindles disposed at a first end of the axle and a like plurality of spindles disposed at a second opposing end of the axle, the plurality of spindles being greater than sixteen spindles, each of the spindles extending radially from the axle, and at least one seal bar assembly disposed on one of the spindles.

There is also provided a blanket sealing bag machine comprising an axle, twenty four spindles disposed at a first end of the axle and twenty four spindles disposed at a second opposing end of the axle, each of the spindles extending radially from the axle, and at least one seal bar assembly disposed on one of the spindles.

There is further provided a blanket sealing machine comprising a drum and a sealing blanket assembly comprising a continuous blanket having an interior portion partially disposed around the drum and an exterior portion providing a return path, a first blanket roller disposed at one side of a mouth region where a web may enter between the sealing blanket assembly and the drum and a second blanket roller disposed at the opposing side of the mouth region, wherein the interior portion of the blanket disposed around the drum defines an angle of blanket wrap, the angle of blanket wrap being greater than approximately two hundred three degrees.

DESCRIPTION OF THE PREFERRED EMBODIMENTS

Figure 1:
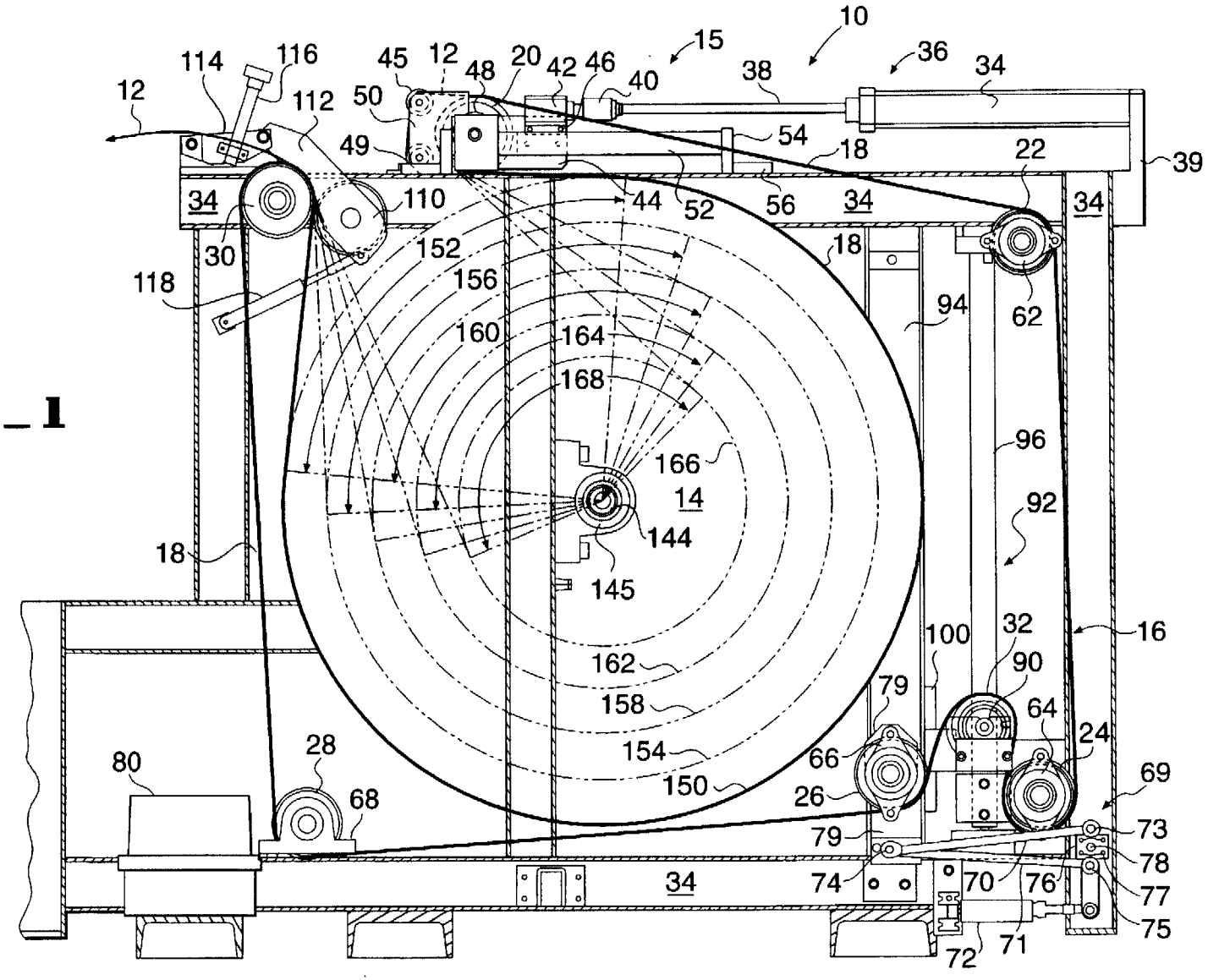
FIG. 1 is a cross sectional view of a blanket sealing bag machine of the present invention and further showing the seal drum with various diameters.

Referring now to FIG. 1, there is shown a blanket sealing bag machine 10 in accordance with the principles of the present invention. Film 12 is provided to the blanket sealing bag machine 10 by conventional means, not shown, such as by a set of nip rolls and dancer arrangement as is standardly done in the industry. Alternatively, the film may be provided to the blanket sealing bag machine 10 by a torque control assembly as discussed below. The blanket sealing bag machine 10 provides transverse heat seals to the film 12 to define individual bags.

The blanket sealing bag machine 10 comprises a sealing drum 14 and a blanket assembly 16 collectively referred to as the sealing drum and blanket assembly 15. Furthermore, the diameter of the sealing drum is preferably adjustable between minimum and maximum limits to increase the range of possible bag lengths and to allow the seals to be imparted to the film 12 at a desired fixed distance from any preprinted matter appearing on the film 12. As will be described more fully hereinafter, the sealing drum 14 comprises one or more seal bars which are selectively activated depending upon the desired length of the bags being produced and the diameter of the sealing drum 14.

The blanket assembly 16 comprises a sealing blanket 18, a plurality of blanket rollers 20, 22, 24, 26, 28, and 30, and a blanket take-up roller 32. The sealing blanket 16 may be constructed of silicone coated polyester or any other suitable heat resistant material and is mounted upon the plurality of blanket rollers 20, 22, 24, 26, 28, and 30 as well as the blanket take-up roller 32 as shown in FIG. 1.

The first blanket roller 20 is preferably not fixed to the frame 34 of the blanket sealing bag machine 10 in order to allow an operator of the machine to have easy access to the interior of the machine should a problem arise. The first blanket roller 20 may be connected to first tension assembly 36. The first tension assembly 36 comprises a blanket tension cylinder 37 which may be a standard pneumatic cylinder manufactured by Festo of Hauppauge, N.Y. The blanket tension cylinder 37 may be secured to the frame 34 of the blanket sealing bag machine 10 via a frame extension 39, such as a piece of steel. The first tension assembly 36 may further comprise a cylinder rod 38. The blanket tension cylinder 37 may be connected to the cylinder rod 38 which may be, for example, a 20 mm diameter cylinder rod formed of steel. The opposing end of the cylinder rod 38 may be secured to a flexible coupling 40 which also forms part of the first tension assembly 36. The flexible coupling 40 may be a rod aligning coupling manufactured by Festo of Hauppauge, N.Y.

Figure 2:
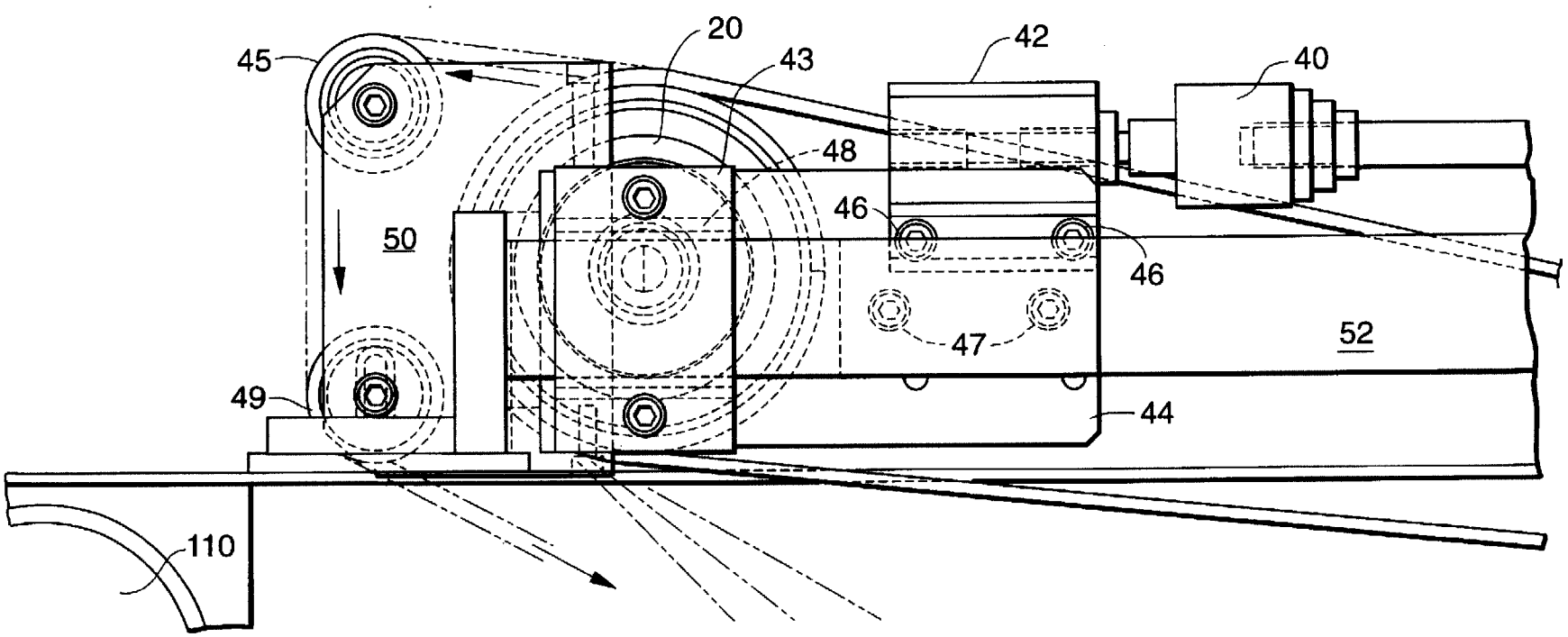
FIG. 2 is an enlarged side view of a portion of the first tension assembly and alternate film entry paths into the sealing drum and blanket assembly.
Figure 3:
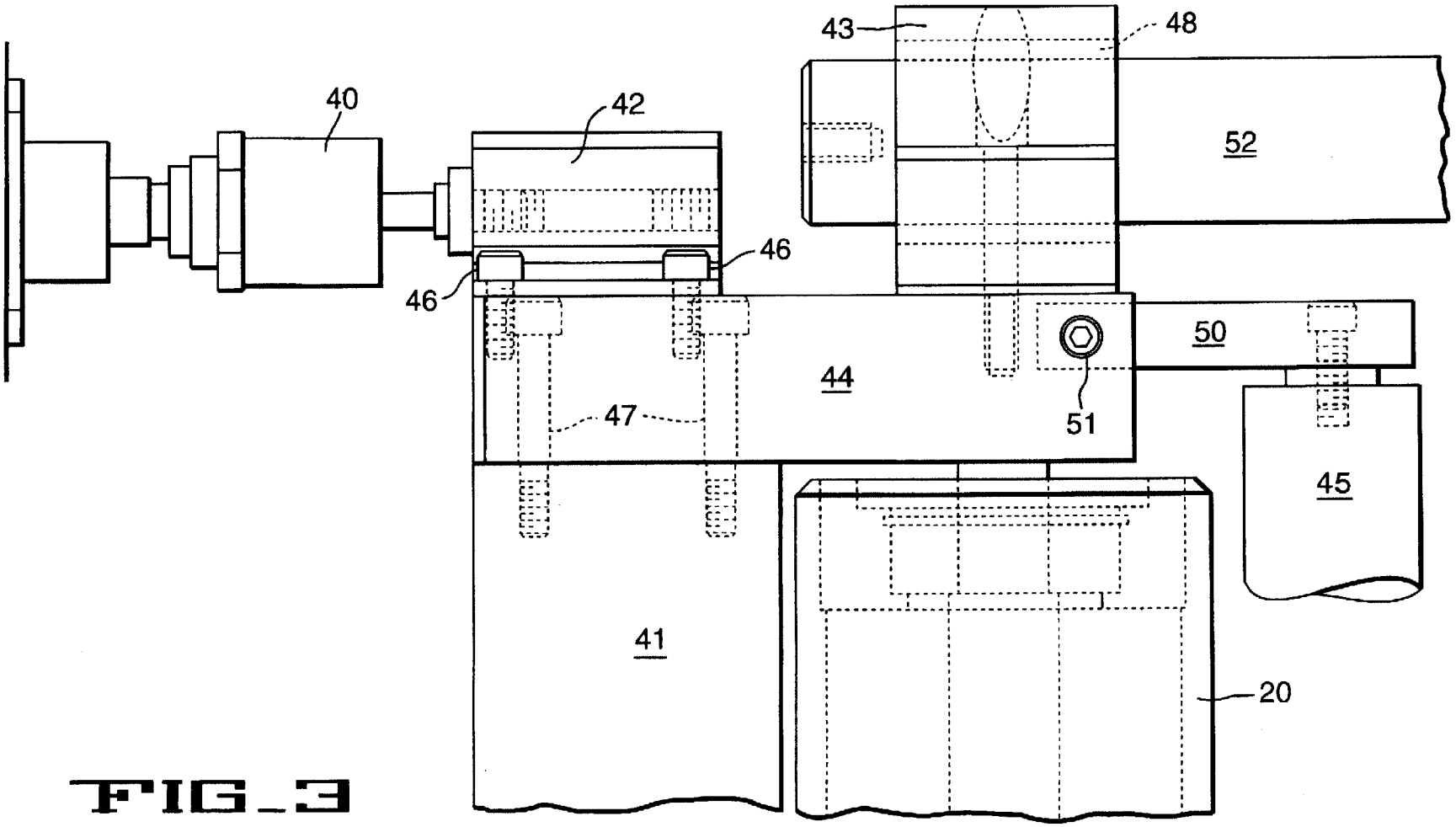
FIG. 3 is an enlarged top view of a portion of the first tension assembly.

Referring also to FIGS. 2 and 3, the flexible coupling 40 may be screwed into a first roller mounting bracket 42. The first roller mounting bracket 42 is secured to a second roller mounting bracket 44 by a plurality of bolts 46 and to a tie bar 41 by a plurality of bolts 47. The tie bar 41 extends from one side to the opposing side of the machine 10. The first and second roller mounting brackets 42 and 44 may be formed of steel. Two separate pairs of roller mounting brackets 42 and 44 may be used to aid in alignment at each side of the machine and the tie bar 41 connects the pairs together.

The second roller mounting bracket 44 is secured to bearing block 43 housing linear bearings 48 which is, in turn, secured to the blanket roller 20. The linear bearings 48 disposed at each end of the blanket roller 20 may be INA linear bearings manufactured by Herzogenauracn of Germany. The bearing block 43 may also be secured to an entry roll mounting bracket 50. The entry roll mounting bracket 50, which may also form part of the first tension assembly 36, may be secured to the second roller mounting bracket via bolts 51. The entry roll mounting bracket 50 may also have an upper entry roll 45 and a lower entry roll 49. Use of the upper entry roll 45 and lower entry roll 49 are optional and provide an alternate film entry path into the sealing drum and blanket assembly 15, as best shown in FIG. 2. Either one or both of the rolls 45 and 49 may be used to alter the angle of entry of the film into the sealing drum and blanket assembly 15. Preferably, the roller mounting brackets 42, 44, the tie bar 41, and the entry roll mounting bracket 50 are formed of steel.

The second roller mounting bracket 44 is slidably mounted on a shaft 52. The dimension of the shaft 52 may be, for example, 20.5 inches in length and 50 mm in diameter. The end of the shaft 52 may be secured to a mounting bracket 54 which is, in turn, secured to a mounting bracket 56. Mounting bracket 56 is secured to the frame 34.

In normal operation, the blanket tension cylinder 37 is activated such that the cylinder rod 38 is in its extended position. As a result, the mounting brackets 42, 46 allow the bracket roller to be in its normal operating condition (i.e., along the leftmost portion of the shaft 52 in the embodiment shown in FIG. 1). When an operator wishes to view the sealing drum 14 or blanket assembly 16, the blanket tension cylinder 37 is deactivated. As a result, the cylinder rod 38 retracts and the blanket roller moves rightward until the mounting bracket 44 rests against the mounting bracket 54. However, the first blanket roller 20 may instead be fixed in position.

Blanket rollers 22, 24, 26, 28, and 30 are preferably fixed blanket rollers as standardly used in the industry. The fixed blanket rollers may be rotationally connected to the frame 34 of blanket sealing bag machine 10. Preferably, fixed blanket rollers 22, 24, and 26 are secured to bearing housings 62, 64, and 66, respectively, as is standardly done in the industry. The bearing housings 62, 64, and 66 may be secured to the frame 34 of the blanket sealing bag machine 10 by securing means such as nuts and bolts, not shown.

Preferably blanket roller 24 is stationary and blanket roller 26 is pivotable for blanket tracking. One end of the bearing housing 66 is secured to a seal blanket tracking linkage 69 as is standardly used in the industry. The seal blanket tracking linkage may comprise two arms 70 and 71, rod end bearings 73 and 75, a mounting plate 76 comprising a plurality of mounting holes 77 for securing the ends of the arms 70 and 71, a pivoting shaft 78, and a piston 72. Further, the bearing housing 66 may be secured to a pivot plate 79 which is, in turn, connected to a linkage point 74 of the seal blanket tracking linkage 69. The seal blanket tracking linkage 69 helps to keep the sealing blanket 18 taut and thus allows for steering of the blanket. Further, blanket roller 28 is preferably a mounted roller secured to a pillow bearing block 68.

Blanket roller 30, which may be a rubber covered roll, is preferably the driving roller. Blanket roller 30 is driven by a main drive motor 80 by the use of conventional pulleys and belts, not shown. The motor 80 may be a 5 hp ac gear motor manufactured by Reliance of Cleveland, Ohio. As a result, the sealing blanket 18 is driven by the motor 80 through a drive belt which is entrained around the fixed blanket roller 30. The contact force between sealing blanket 18 and sealing drum 14 in turn causes sealing blanket to drive the sealing drum and thereby draw film through the blanket sealing bag machine 10. The blanket roller 30 in the embodiment shown rotates in a counter clockwise direction so that the film 12 travels in a clockwise direction. As a result, the film 12 may travel from blanket roller 20 (or from the upper entry roller 45 and/or lower entry roller 49 if either or both are used), around the sealing drum 14 and exit at blanket roller 30.

The blanket take-up roller 32 helps to ensure that the sealing blanket 18 is kept taut against the sealing drum 14 regardless of the diameter of the sealing drum 14. The blanket take-up roller has bearings 90 at each end, allowing the roller to rotate about its axis. The blanket take-up roller 32 as well as the other blanket rollers 20, 22, 24, 26, 28, and 30 are preferably steel rollers having a diameter of approximately five-and-a-half inches.

Figure 4:
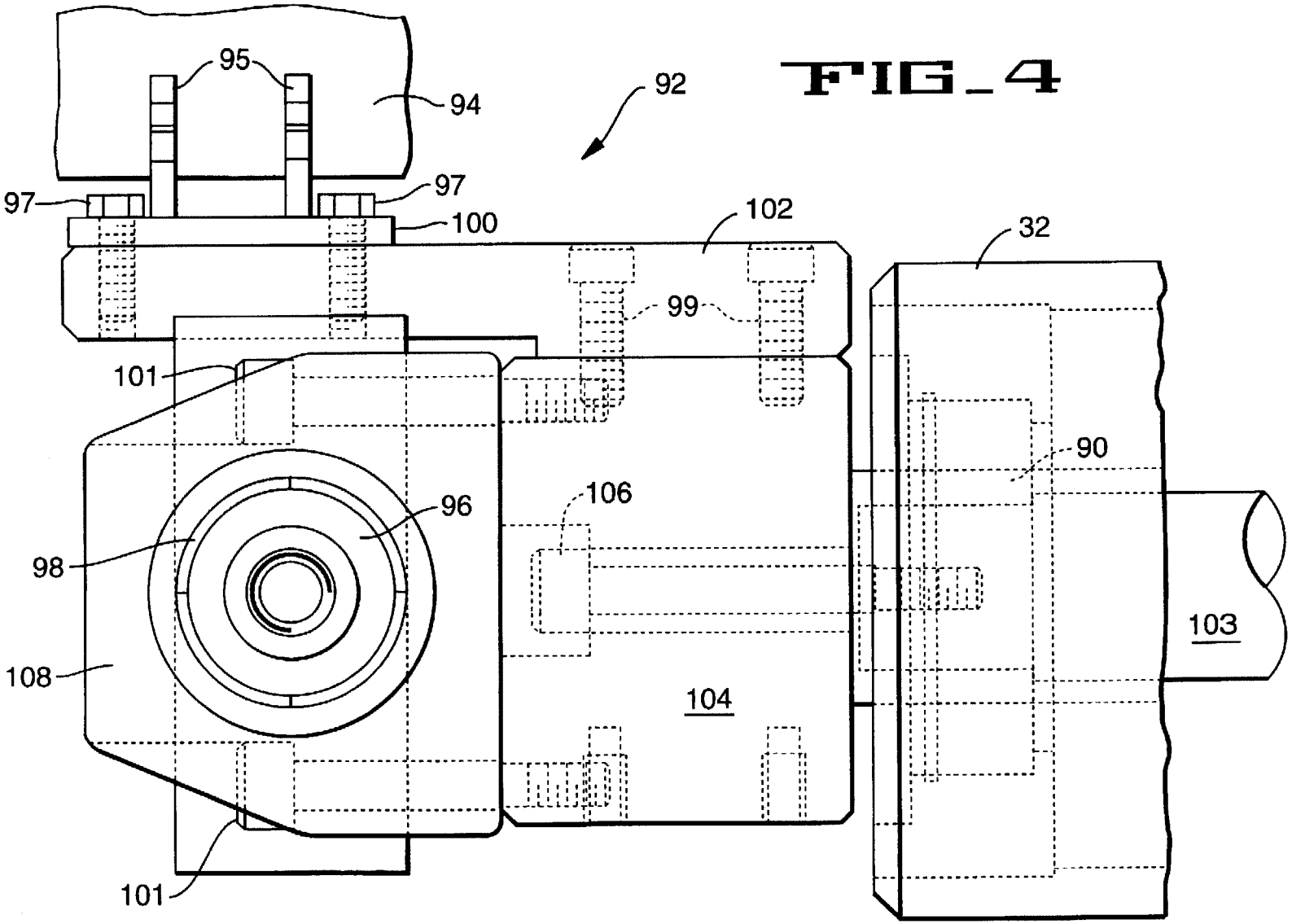
FIG. 4 is a top view of the blanket take-up roller and second tension assembly.

Referring also to FIG. 4, the blanket take-up roller 32 is mounted onto a second tension assembly 92. Preferably, the second tension assembly 92 comprises a linear rodless cylinder 94 disposed at each end of the blanket take-up roller 32 as is standardly used in the industry. The second tension assembly 92 further comprises a shaft 96, linear bearing 98, clevis plate 100, mounting plate 102, mounting block 104, shoulder bolt 106, and bearing block 108. The rodless cylinder 94 may be connected to the clevis plate 100 via yokes 95 disposed on the clevis plate. Clevis plate 100 may be secured to the mounting plate 102 by bolts 97 and mounting plate 102 may be secured to mounting block 104 by bolts 99. Bolts 101 may also secure the mounting block 104 to the bearing block 108. Shoulder bolt 106 may be secured to the axle 103 of the blanket take-up roller 32.

The sealing blanket 18 tension is controlled by how much pressure is exerted on the rodless cylinders 94 disposed at each end of the machine. The rodless cylinders 94 exert pressure to raise or lower the blanket take-up roller 32. Specifically, in order to keep the blanket take-up roller 32 in equilibrium, the rodless cylinders 94 will exert an upward or downward force. Because the clevis plate 100, mounting plate 102 and mounting block 104 are secured together at each end and because the clevis plate 100 at each end is attached to the rodless cylinder 94 at each end, the mounting block 104 moves upward or downward in synchronization with the clevis plate 100 at each end. Further, because the mounting block 104 is securing to the bearing block 108, the mounting block moves upward or downward in parallel to the shaft 96 by the use of linear bearings 98 housed in the bearing block. Moreover, because the mounting block 104 is secured to the axle 103 of the blanket take-up roller 32 by the use of shoulder bolt 106, the blanket take-up roller 32 moves upward or downward in synchronization with the force provided by the rodless cylinders 94.

For example, in order for the sealing blanket 18 to be taut, there may be a force vector of three hundred pounds exerted by the blanket take-up roller 32 in the upward direction along the rodless cylinders 94 and two force vectors of one hundred fifty pounds in the downward direction toward the blanket rollers 24 and 26. The blanket take-up roller 32 will move upward or downward should the sum of the downward force vectors not equal the value of the upward force vector exerted on the blanket take-up roller 32. That is, if the upward force vector equals two hundred ninety pounds, then there are two force vectors of one hundred forty five pounds in the downward direction toward the blanket rollers 24 and 26. Therefore, the blanket take-up roller 32 is kept in equilibrium.

Where the diameter of the sealing drum 14 changes, the second tension assembly 92 takes up the required excess or provides additional length of the sealing blanket 18. For example, where the sealing drum 14 circumference decreases from one hundred fifty inches to sixty seven inches, the excess of approximately eighty three inches of sealing blanket 18 is taken up by the web path changes and the second tension assembly 92. As a result, blanket take-up roller 32 will raise approximately 750 min. Additionally, the tension assembly 92 helps ensure that the blanket is kept taut by the motion of the blanket take-up roller 32. Similarly, the blanket take-up roller 32 will lower by a similar amount if the sealing drum 14 circumference is increased back to one hundred fifty inches.

The first tension assembly 36 holding blanket roller 20 in place preferably has a force which is greater than the force applied by the second tension assembly 92 against the blanket take-up roller 32. For example, the force applied by the first tension assembly 36 against the blanket roller 20 may be approximately four hundred pounds and the force applied by the second tension assembly 92 against the blanket take-up roller 32 may be approximately three hundred pounds. As a result, the first tension assembly 36 effectively mounts the blanket roller 20 in a fixed position and all movement to retain the sealing blanket 18 taut as well as taking up the required excess or providing additional length of the sealing blanket 18 is provided by the second tension assembly 92.

After passing through sealing drum and blanket assembly 15, the firm 12 passes under a chill roll 110 which functions to cool the heat seals. The chill roll 110 may be mounted to an arm 112 which is pivotally secured to another arm 114. Arm 114 is, in turn, secured to the frame 34. Further, a threaded rod 116 having a knob on top is secured to the arm 114 to adjust the position of the chill roll 110. The chill roll 110 may also be secured to a tension cylinder 118 to help ensure contact between the chill roll 110 and the film 12 and to allow for ease of threading of the film 12 under the chill roll 110. Thereafter, the film 12 may be directed into a folding assembly and cutting assembly, not shown, as is standardly done in the bag making industry for forming bags.

Figure 5:
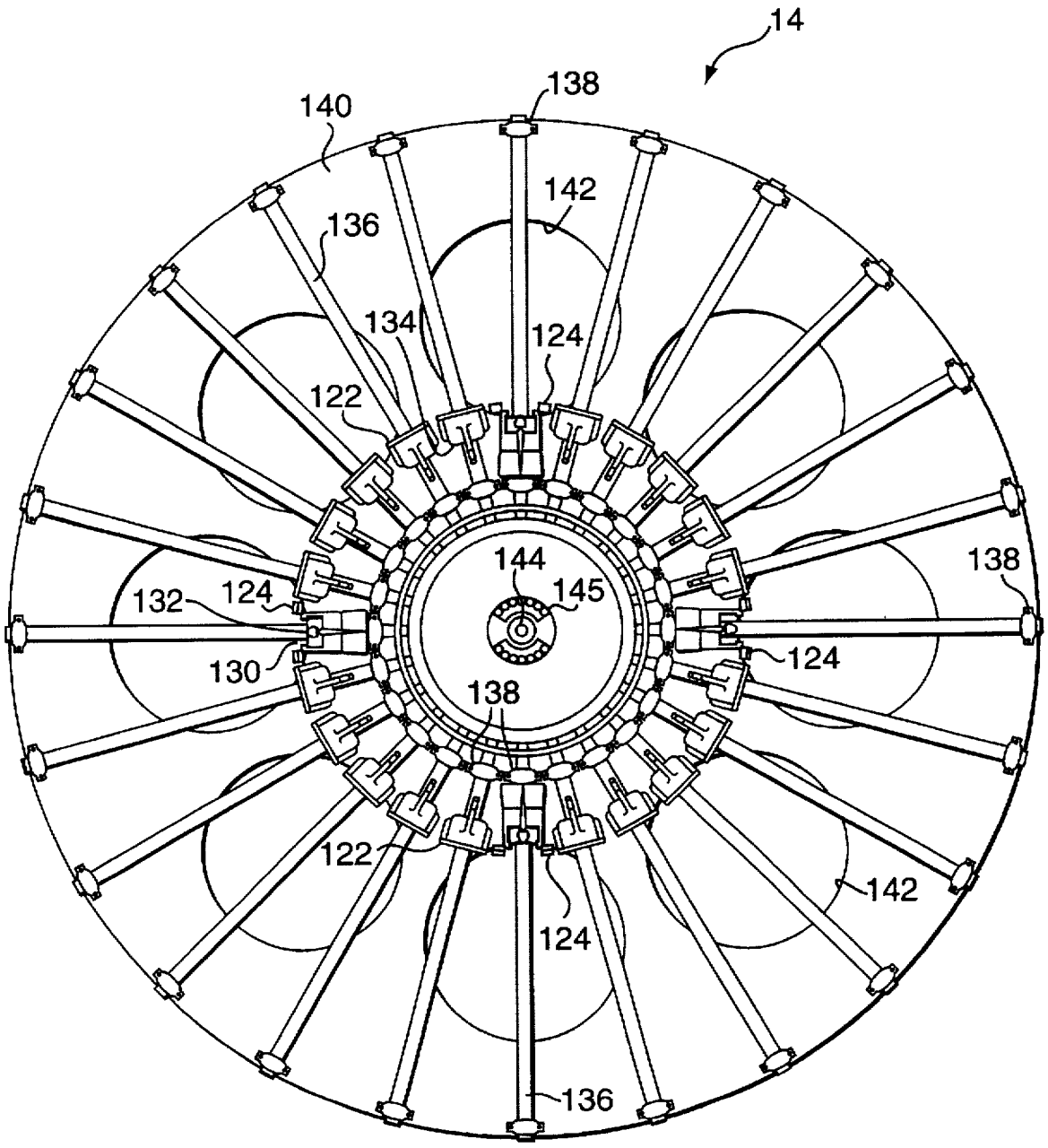
FIG. 5 is an end view of the sealing drum of the present invention.

Referring to also to FIG. 5, the sealing drum 14 is mounted on a shaft 144 which is rotatably supported with bearing assemblies housed in a bearing block 145 connected to the frame 34 of the bag machine. Blanket roller 30 is conventionally driven by a motor 80 which, in turn, imparts motion to the sealing blanket 18. Because the sealing blanket 18 is in intimate contact with the sealing drum 14, the sealing blanket 18 causes the sealing drum 14 to rotate about the shaft 144.

The surface of the sealing drum 14 is comprised of a number of spaced apart slats 122 and seal bars 124. Although FIG. 5 illustrates the use of twenty slats 122 and four seal bars 124, any combination of slats 122 or seal bars 124 may be used. Preferably, where the sealing drum comprises a given number of spindles, the number of seal bars used is an integral multiplicand of the given number of spindles. Where more than one seal bar 124 is used, preferably the seal bars are spaced equidistant from one another. Slats 122 may then be placed on the remaining spindles.

Where, for example, a twenty four spindle sealing drum 14 is employed (i.e., twenty four spindles at each end of the sealing drum 14), then a seal bar 124 may be placed on one, two, three, four, six, eight, twelve, or all of the spindles (i.e., integral multiplicands of twenty four spindles) during a given production run. Moreover, where a thirty six spindle sealing drum 14 is employed (i.e., thirty six spindles at each end of the sealing drum 14), then a seal bar 124 may be placed on one, two, three, four, six, nine, twelve, eighteen, or all of the spindles (i.e., integral multiplicands of thirty six spindles) during a given production run. Similarly, where an eighteen spindles sealing drum 14 is employed (i.e., eighteen spindles at each end of the sealing drum 14), then a seal bar 124 may be placed on one, two, three, six, nine, or all of the spindles (i.e., integral multiplicands of eighteen spindles) during a given production run. Slats 122 may then be placed on the remaining spindles. Where seventeen spindles are employed, then seal bars 124 may be placed on one or all of the spindles during a given production run. Preferably, the sealing drum 14 comprises twenty four spindles.

Conventional slats 122 and seal bars or seal assemblies 124 may be employed on the seal drum 14. Preferably, the slats are T-bar sections and the seal bars are U-shaped sections extending longitudinally substantially the width of the sealing drum. The outer surface of each slat 122 is slightly curved and is overlaid with an appropriate rubber-type material such as adiprene to increase the frictional force between the sealing blanket 18 and the sealing drum 14. Each seal bar 124 also comprises an outer surface overlaid with an appropriate rubber-type material such as adiprene, but in addition comprises a longitudinal opening 130 in the outer surface through which a heating element 132 protrudes. Each heating element 132 approximately extends the length of the seal bar 124 and is selectively activated depending on the desired length of the bags being produced to impart a transverse seal onto the film 12 as the film passes between the seal bar 124 and sealing blanket 18. The ends of the slats 122 and seal bars 124 comprises threaded blocks 134 which engage corresponding threaded spindles 136. The spindles 136 are rotatably supported at each end within yokes 138 (i.e., there are two yokes for a given spindle) secured to the side walls or disk 140 of the sealing drum 14. Preferably, the spindles 136 are spaced equidistant from one another. Further, the disk 140 may have a series of holes 142 evenly dispersed around the disk to lighten the weight of the disk 140 in order to reduce the overall weight of the sealing drum 14, allowing the drum to rotate more efficiently. The disks 140 may be secured to a shaft or axle 144 as is standardly done in the industry.

The adjustability of the diameter of the sealing drum 14 is provided through rotation of the spindles 136 which is accomplished through the selective activation of a bi-directional motor and drive mechanism, not shown. Preferably, the bi-directional motor is mounted on the shaft 144 within the sealing drum 14. The operation of the hi-directional motor and drive mechanism to change the relative position of the slats 122 and seal bars 124 may, for example, be as described in U.S. Pat. No. 5,447,486.

Referring back to FIG. 1, the sealing drum 14 is shown having various diameters. The sealing blanket angle of wrap preferably ranges from approximately two hundred seventy five degrees where the sealing drum 14 diameter is at a maximum to approximately one hundred eighty degrees where the sealing drum 14 is at its minimum diameter. However, preferably, the blanket angle of wrap ranges from approximately two hundred seventy five degrees to approximately three hundred degrees where the sealing drum is at its maximum diameter to approximately two hundred degrees when the sealing drum is at its minimum diameter.

Blanket roller 20 is preferably placed such that the angle of wrap is approximately two hundred seventy five degrees to approximately three hundred degrees when the sealing drum 14 is at its maximum diameter. Further, the angle of blanket wrap is reduced as the sealing drum 14 diameter is reduced because the blanket rollers 20 and 30 are in a given position.

For example, where the maximum circumference 150 of the sealing drum 14 is one hundred fifty inches, the blanket angle of wrap 152 may be two hundred seventy two degrees. Where the circumference 154 of the sealing drum 14 is 129.25 inches, the blanket angle of wrap 156 may be two hundred fifty degrees. Where the circumference 158 of the sealing drum 14 is 108.5 inches, the blanket angle of wrap 160 may be two hundred thirty two degrees. Where the circumference 162 of the sealing drum 14 is 87.75 inches, the blanket angle of wrap 164 may be two hundred seventeen degrees. Where the minimum circumference 166 is sixty seven inches, the blanket angle of wrap 168 may be two hundred three degrees. Therefore, the blanket angle of wrap may, for example, be greater than approximately two hundred three degrees, greater than approximately two hundred seventeen degrees, greater than approximately two hundred thirty two degrees, greater than approximately two hundred fifty degrees, and greater than approximately two hundred seventy two degrees.

Figure 6:
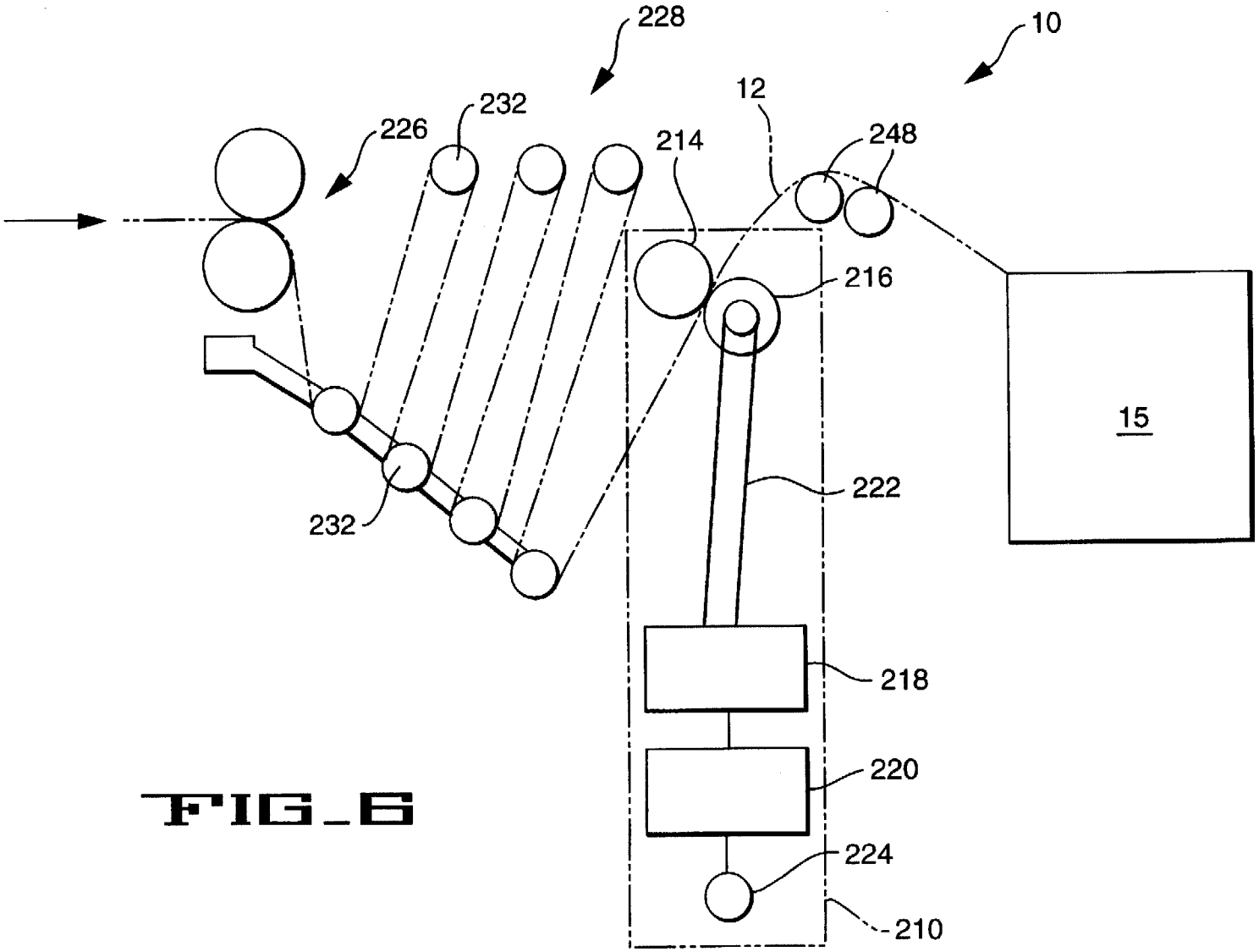
FIG. 6 is an end view of a torque driven assembly and sealing drum and blanket assembly.

As referred to above, the torque control assembly 210 for providing the film 12 to the blanket sealing bag machine 10 may be as shown in FIG. 6. The torque control assembly 210 comprises torque driven means such as torque driven rolls 214 and 216, a motor 218, and a drive 220. The torque control assembly 10 further comprises a connecting means 222. The connecting means 222, which is preferably a timing belt, may be any suitable means for operatively connecting roll 216 to the motor 218.

The motor 218 may, for example, be a DC motor, such as a one horsepower motor manufactured by Reliance Electric Corporation. Further, the drive 220 may, for example, be a DC Torque Drive Series R400 manufactured by Danfoss Electronic Drives, a division of Danfoss, Inc. However, the drive 220 may be any DC, AC, or servo torque drive and the motor may be any DC, AC, or servo motor.

The torque control assembly 210 may further comprise a torque setting control 224 which may be connected to the control inputs of the drive 220. The torque setting control 224 is preferably a potentiometer, such as a ten turn, five K-Ohm, one quarter watt potentiometer. The potentiometer 224 provides a variance in how much force or torque the motor 228 provides to the rolls 214 and 216. Alternatively, the torque setting control 224 may be any process level input device such as load cells. A load cell may, for example, be placed before and after the torque driven rolls 214 and 216 to sense the tension in the web 12 and activate the motor 218 when too large of a tension is placed on the web 12.

The torque control assembly 210 may, for example, be disposed between a pair of nip rolls 226 and dancer assembly 228 at one end and sealing drum and blanket assembly 15 at an opposing end. The dancer assembly 228 may comprise a plurality of conventional dancer rolls 232. A plurality of guide rolls 248 may also be disposed between the torque control assembly 10 and the sealing drum and blanket assembly 15.

The web 12 of plastic film is provided from a standard film supply to the pair of nip rolls 226 and to the dancer assembly 228. The web of film 12 is disposed between the torque driven rolls 214 and 216 of the torque control assembly 210. The web 12 is further provided to the sealing drum and blanket assembly 15.

The web 12 of plastic film is continuously provided to the sealing drum and blanket assembly 15. When the potentiometer 224 is set to zero, the motor 218 may not provide any force to help the flow of the web 12 to reduce the tension in the web in the region prior to entering the sealing drum and blanket assembly 15. The potentiometer 224 setting may gradually be increased such that there is little or no tension in the web 12 in the region prior to entering the sealing drum and blanket assembly 15. That is, when the potentiometer 224 setting is gradually increased, the drive 220 drives the motor 218 at a faster rate. This, in turn, drives the torque driven rolls 214 and 216 at a faster rate via timing belt 222. As a result, the tension in the web 12 at the output of the torque control assembly 210 lessens. By further increasing the potentiometer 224 setting, the tension in the web 12 at an output of the torque control assembly 210 may further lessen such that there is little or no tension at the output of the torque control assembly 210.

Figure 7:
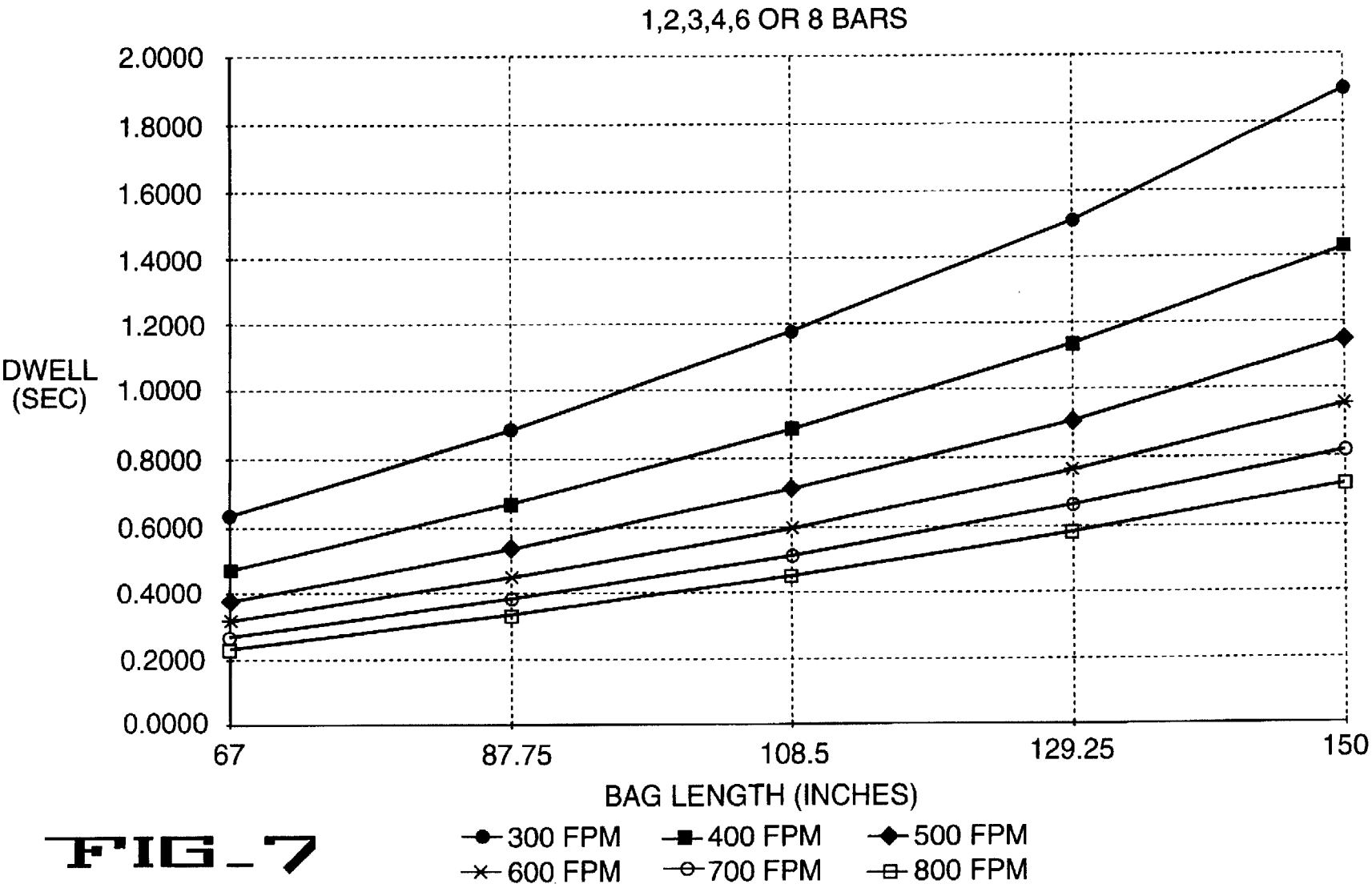
FIG. 7 is a graph illustrating seal dwell time versus bag length for a blanket sealing bag machine of the present invention.

In a typical application, 200 ms of seal dwell time may be required in order to properly seal a polyethylene film 12. Therefore, if the seal dwell time is greater than that figure, then the blanket sealing bag machine may be operated at a higher speed. Referring now to FIG. 7, there is shown a plot of seal dwell time versus bag length for various operating speeds for a blanket sealing bag machine constructed in accordance with the principles of the present invention whose variable circumference ranges from sixty seven to one hundred fifty inches. As seen, the blanket sealing bag machine may produce an appropriate seal even where the film is moving as fast as eight hundred feet per minute.

It should be recognized that, while the present invention has been described in relation to the preferred embodiments thereof, those skilled in the art may develop a wide variation of structural details without departing from the principles of the invention. Therefore, the appended claims are to be construed to cover all equivalents falling within the true scope and spirit of the invention.

What is claimed is:

1. A sealing drum and blanket assembly comprising a sealing drum having a variable sealing drum diameter, said sealing drum comprising an axle, a first plurality of spindles disposed at a first end of said axle and a second plurality of spindles disposed at a second opposing end of said axle, said first and second plurality of spindles each being greater than sixteen spindles, each of said spindles extending radially from said axle; at least one seal bar assembly disposed on one of said spindles;

a blanket assembly comprising a blanket surrounding at least a portion of said sealing drum disposed such that a web of film is held directly against said blanket for at least 180 degrees;

a first blanket roller disposed at one side of a mouth region where said web of film enters between said sealing drum and said blanket assembly and a second blanket roller disposed at an opposing end of said mouth; and a first tension assembly connected to said first blanket roller for applying a first tension force to said web of film against said sealing drum, said first tension assembly being retractable;

wherein said blanket assembly further comprises a second tension assembly for applying a second tension force less than said first tension force to said web of film against said sealing drum in order to maintain a taut tension equilibrium around said sealing drum when said drum changes diameter.

2. The invention of claim 1 wherein said spindles are spaced equidistant from one another.

3. The invention of claim 1 wherein each of said first and second plurality of spindles comprises twenty four or more spindles.

4. The invention of claim 1 wherein said sealing blanket assembly has an angle of wrap between approximately 200 degrees to approximately 300 degrees.

5. The invention of claim 1 further comprising a torque control assembly for providing film to a sealing drum and blanket assembly.

6. The invention of claim 1 wherein said first tension assembly comprises a blanket tension cylinder.

7. The invention of claim 6 wherein said second tension assembly comprises a blanket take-up roller and wherein said first tension assembly holds said first blanket roller in place at said first tension force which is greater than said second tension force applied by said second tension assembly against said blanket take-up roller.

8. A blanket sealing bag machine comprising:

a sealing drum having a variable sealing drum diameter, said sealing drum comprising an axle, twenty four spindles disposed at a first end of said axle and twenty four spindles disposed at a second opposing end of said axle, each of said spindles extending radially from said axle, and at least one seal bar assembly disposed on one of said spindles;

a first blanket roller disposed at one side of a mouth region where a web of film enters between said sealing drum and a blanket assembly and a second blanket roller disposed at an opposing end of said mouth;

a first tension assembly connected to said first blanket roller comprising a cylinder, said first tension assembly being retractable;

said blanket assembly comprising a blanket and a second tension assembly, said second tension assembly comprising rodless cylinders and a blanket take-up roller;

where said web of fill provided to said sealing drum and blanket assembly is directly disposed against said blanket for at least 180 degrees; and wherein said first tension assembly hold said first blanket roller in place at a first tension force which is greater than a second tension force applied by said second tension assembly against said blanket take-up roller in order to maintain a taut tension equilibrium around said sealing drum when said drum changes diameter.

9. The invention of claim 8 wherein said spindles are spaced equidistant from one another.

10. The invention of claim 8 having two or more seal bar assemblies, said two or more seal bar assemblies being spaced equidistant from one another.

11. The invention of claim 8 wherein said sealing blanket assembly has an angle of wrap between approximately 200 degrees to approximately 300 degrees.

12. A blanket sealing machine comprising:

a sealing drum having a variable drum diameter;

a sealing blanket assembly comprising a continuous blanket having an interior portion partially disposed around said drum and an exterior portion providing a return path, a first blanket roller disposed at one side of a mouth region where a web of film enters between said sealing blanket assembly and said drum and a second blanket roller disposed at an opposing side of said mouth region;

a first tension assembly connected to said first blanket roller for applying a first tension force to said web against said sealing drum, said first tension assembly being retractable;

where said blanket assembly further comprises a second tension assembly for applying a second tension force less than said first tension force to said web of film against said sealing drum in order to maintain a taut tension equilibrium around said sealing drum when said drum changes diameter; and wherein said interior portion of said blanket disposed around said drum defines an angle of blanket wrap, said angle of blanket wrap being greater than approximately two hundred three degrees and wherein said web of film provided to said blanket sealing machine is directly disposed against said blanket for said angle of blanket wrap.

13. The invention of claim 12 wherein said angle of wrap is greater than approximately two hundred seventeen degrees.

14. The invention of claim 12 wherein said angle of wrap is greater than approximately two hundred thirty two degrees.

15. The invention of claim 12 wherein said angle of wrap is greater than approximately two hundred fifty degrees.

16. The invention of claim 12 wherein said angle of wrap is greater than approximately two hundred seventy two degrees.

17. The invention of claim 12 wherein said first tension assembly comprises a blanket tension cylinder.

18. The invention of claim 17 wherein said second tension assembly further takes up excess of said sealing blanket when a diameter of said drum is reduced and provides additional length of said sealing blanket when said diameter of said drum is enlarged, said second tension assembly comprising a blanket take-up roller to retain said sealing blanket taut and wherein said first tension assembly holds said first blanket roller in place at said first tension force which is greater than said second tension force applied by said second tension assembly against said blanket take-up roller.

19. The invention of claim 12 wherein said drum comprises an axle, a first plurality of spindles disposed at a first end of said axle and a like plurality of spindles disposed at a second opposing end of said axle, said plurality of spindles being greater than sixteen spindles, each of said spindles extending radially from said axle, and at least one seal bar assembly disposed on one of said spindles.

20. The invention of claim 19 wherein said drum comprises twenty four spindles at each end of said axle.

* * * * *